US010938125B2

(12) United States Patent
Yamada et al.

(10) Patent No.: US 10,938,125 B2
(45) Date of Patent: Mar. 2, 2021

(54) CONNECTION TERMINAL AND TERMINAL CONNECTION STRUCTURE

(71) Applicant: YAZAKI CORPORATION, Tokyo (JP)

(72) Inventors: Go Yamada, Kakegawa (JP); Takahiko Sato, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 40 days.

(21) Appl. No.: 16/433,096

(22) Filed: Jun. 6, 2019

(65) Prior Publication Data

US 2019/0379142 A1 Dec. 12, 2019

(30) Foreign Application Priority Data

Jun. 11, 2018 (JP) ..... 2018-111229

(51) Int. Cl.
*H01R 13/28* (2006.01)
*H01R 4/02* (2006.01)
*H01R 43/02* (2006.01)

(52) U.S. Cl.
CPC ..... *H01R 4/023* (2013.01); *H01R 4/029* (2013.01); *H01R 43/0207* (2013.01)

(58) Field of Classification Search
CPC ..... H01R 13/28
USPC ..... 439/290, 291
See application file for complete search history.

(56) References Cited

U.S. PATENT DOCUMENTS 2,326,327 A * 8/1943 Brewer ..... 439/291
3,208,030 A * 9/1965 Evans ..... H01R 13/28 439/290
3,846,735 A * 11/1974 Carter ..... H01R 13/35 439/284
4,367,910 A * 1/1983 Seidler ..... H01R 12/57 439/857
4,552,425 A * 11/1985 Billman ..... H01R 13/28 439/295
4,904,212 A * 2/1990 Durbin ..... H01R 43/205 29/845

(Continued)

FOREIGN PATENT DOCUMENTS

FR 1121148 A 7/1956
JP 62-193682 U 12/1987

(Continued)

*Primary Examiner* — Neil Abrams
(74) *Attorney, Agent, or Firm* — Sughrue Mion, PLLC

(57) ABSTRACT

A connection terminal includes: a base portion; a folded portion folded back from a rear end of the base portion and extending toward a front side in the terminal fitting direction; a rise portion that is provided at the folded portion and rises in a direction away from the base portion; and a terminal contact portion extending from the rise portion toward the front side and being elastically deformable in a direction away from the base portion. The connection terminal is configured to receive a base portion of a counterpart connection terminal having a same configuration as that of the connection terminal such that the base portion of the counterpart connection terminal is inserted and elastically sandwiched between the base portion and the terminal contact portion of the connection terminal while the counterpart connection terminal is vertically inverted with respect to the connection terminal.

9 Claims, 10 Drawing Sheets

(56) References Cited

U.S. PATENT DOCUMENTS

| | | | | | |
|---|---|---|---|---|---|
| 4,963,102 | A * | 10/1990 | Gettig | H01R 13/28 | 439/291 |
| 5,035,639 | A * | 7/1991 | Kilpatrick | H01R 13/28 | 439/290 |
| 5,577,928 | A * | 11/1996 | Duclos | H01R 13/28 | 439/290 |
| 5,997,347 | A * | 12/1999 | Robinson | H01R 13/426 | 439/517 |
| 6,568,955 | B2 * | 5/2003 | Hotea | H01R 12/79 | 439/260 |
| 6,910,925 | B2 * | 6/2005 | Endo | H01R 13/187 | 439/856 |
| 6,932,660 | B2 * | 8/2005 | Roepke | H01M 2/20 | 439/856 |
| 10,193,261 | B2 * | 1/2019 | Pittenger | H01R 13/05 | |
| 10,686,271 | B2 * | 6/2020 | Schaeuble | H01R 13/20 | |

FOREIGN PATENT DOCUMENTS

| | | | |
|---|---|---|---|
| JP | 2002-25674 | A | 1/2002 |
| JP | 2015-144083 | A | 8/2015 |
| JP | 2017-188373 | A | 10/2017 |
| WO | 2017/191046 | A1 | 11/2017 |

* cited by examiner

CONNECTION TERMINAL AND TERMINAL CONNECTION STRUCTURE

CROSS-REFERENCES TO RELATED APPLICATIONS

This application is based on and claims priority from Japanese Patent Application No. 2018-111229 filed on Jun. 11, 2018, the entire contents of which are incorporated herein by reference.

FIELD

One or more embodiments of the present invention relate to a connection terminal and a terminal connection structure.

BACKGROUND

JP-A-2002-25674 discloses a male-female common terminal which can be used without distinguishing between a male terminal and a female terminal. According to such a male-female common terminal, the manufacturing cost can be reduced by realizing a single type of connection terminals having a common structure which allows the connection terminals are connected to each other.

The connection terminal disclosed in JP-A-2002-25674 includes an electric wire connection portion on one side and a terminal connection portion on the other side. The terminal connection portion includes a tab connection portion having an elongated plate shape, an embossed portion formed in a protruding shape on one surface of the tab connection portion, and tab hold pieces that extend from side edge portions of the tab connection portion on the side of the electric wire connection portion and are disposed to oppose each other with a predetermined distance on the one surface of the tab connection portion.

When the connection terminal is used for connection between electric wires, crimp pieces of the electric wire connection portions are crimped and connected to electric wire ends, respectively, and the terminal connection portions of the connection terminals attached to the electric wires are connected to each other.

SUMMARY

The connection terminal as described above is formed by, for example, punching out chain terminals, formed by connecting in parallel terminals of a predetermined shape to a strip-like carrier, from a flat conductive metal plate, and then separating each of the terminals from the carrier. Therefore, although the male-female terminals can be manufactured in only one shape, when the number of contacts and the contact area and the like of the terminals are changed, it is necessary to change a press mold having a predetermined shape that is punched out from a flat conductive metal plate, resulting in an increase in the manufacturing cost.

One or more embodiments of the present invention have been made in view of the above circumstances, and an object thereof is to provide a connection terminal and a terminal connection structure capable of reducing the manufacturing cost by realizing a single type of connection terminals, and also capable of changing the number of contacts or the contact area of the terminals while reducing the manufacturing cost.

The object of one or more embodiments of the present invention described above is achieved by the connection terminal and the terminal connection structure of the following items.

(1) A connection terminal includes: a base portion having a flat shape; a folded portion which is folded back from a rear end of the base portion in a terminal fitting direction and extends toward a front side in the terminal fitting direction; a rise portion that is provided at an intermediate portion of the folded portion in the terminal fitting direction and rises in a direction away from the base portion; and a terminal contact portion that extends from the rise portion toward the front side in the terminal fitting direction and is elastically deformable in the direction away from the base portion at a position facing the base portion. The connection terminal is configured to receive a base portion of a counterpart connection terminal having a same shape as that of the connection terminal such that the base portion of the counterpart connection terminal is inserted and elastically sandwiched between the base portion and the terminal contact portion of the connection terminal while the counterpart connection terminal is vertically inverted with respect to the connection terminal.

According to the connection terminal of the item (1), a pair of connection terminals (the connection terminal and the counterpart connection terminal) can be electrically connected to each other by elastically sandwiching the base portion of the counterpart connection terminal by the base portion and the terminal contact portion. Therefore, it is not necessary to distinguish male and female of the connection terminals, so that the workability is high and the component management is facilitated. Therefore, the manufacturing cost of the connection terminals can be reduced by realizing a single type of connection terminals as male-female common terminals.

Further, according to the connection terminal having the configuration, a portion for forming base portions has a strip-like busbar shape extending in a longitudinal direction of an elongated flat conductive metal plate. In addition, the folded portion folded back from the rear end of the base portion in the terminal fitting direction, the rise portion provided at the intermediate portion of the folded portion in the terminal fitting direction, and the terminal contact portion extending from the rise portion toward the front side in the terminal fitting direction, are integrally bent and formed. Accordingly, an elongated bent body can be formed to have a target shape (the same cross-sectional shape along the longitudinal direction) in the longitudinal direction of the elongated flat conductive metal plate. Therefore, by cutting the elongated bent body at arbitrary cutting positions in the longitudinal direction, the connection terminals can be easily formed to have different lengths in a width direction intersecting with the terminal fitting direction. Therefore, according to the connection terminal having the configuration, the number of contacts and the contact area of the terminals and the like can be changed.

(2) In the connection terminal according to the item (1), the terminal contact portion includes a contact portion which is provided at an intermediate portion of the terminal contact portion in the terminal fitting direction and which is bent so as to protrude toward the base portion.

According to the connection terminal of the item (2), the terminal contact portion includes the contact portion which is provided at an intermediate portion of the terminal contact portion in the terminal fitting direction and which is bent so as to protrude toward the base portion. Therefore, when the base portion of the counterpart connection terminal is inserted from the front side in the terminal fitting direction, a tip end of the base portion of the counterpart connection terminal pushes up an inclined surface of a tip end of the terminal contact portion to smoothly enter between the base portion and the terminal contact portion. Since the contact portion of the terminal contact portion come into contact with the base portion of the counterpart connection terminal, the contact portion of the terminal contact portion can be reliably brought into contact with the base portion of the counterpart connection terminal even when prying occurs in a vertical direction (a thickness direction) with respect to the connection terminals. Therefore, the contact area between the connection terminals can be prevented from reducing, thereby ensuring the connection reliability.

(3) In the connection terminal according to the item (1) or (2), the base portion includes a contact protrusion that protrudes toward the terminal contact portion from a surface of the base portion facing the terminal contact portion.

According to the connection terminal of the item (3), since the contact protrusion of the base portion reliably come into contact with the base portion of the counterpart connection terminal, the contact area is increased due to the increase in the number of contacts between the connection terminals, thereby improving the connection reliability.

(4) In the connection terminal according to any one of the items (1) to (3), the terminal contact portion includes a plurality of divided pieces formed by dividing the terminal contact portion in the width direction intersecting the terminal fitting direction by a slit formed between adjacent ones of the plurality of divided pieces and extending from a front end of the terminal contact portion along the terminal fitting direction According to the connection terminal of the item (4), since the terminal contact portion includes the plurality of divided pieces, each of the divided pieces can independently come into contact with the base portion of the counterpart connection terminal. Therefore, the divided pieces of the terminal contact portion can be reliably brought into contact with the base portion of the counterpart connection terminal even when prying occurs in a rotation direction (a direction of rotating about the terminal fitting direction) with respect to the connection terminals. Therefore, the contact area between the connection terminals can be prevented from reducing, thereby ensuring the connection reliability.

(5) In the connection terminal according to the item (1), the terminal contact portion includes a plurality of divided pieces formed by dividing the terminal contact portion in a width direction intersecting the terminal fitting direction by a slit formed between adjacent ones of the plurality of divided pieces and extending from a front end of the terminal contact portion along the terminal fitting direction, the terminal contact portion includes a plurality of contact portions which are provided at intermediate portions of the plurality of divided pieces in the terminal fitting direction, respectively, and which are bent so as to protrude toward the base portion, and the plurality of contact portions are provided at different positions along the terminal fitting direction, respectively.

According to the connection terminal of the item (5), when the base portion of the counterpart connection terminal is inserted from the front side in the terminal fitting direction, the tip ends of the base portions of the counterpart connection terminals reaches sandwiching positions of the divided pieces at different timings, respectively, and a peak value of the insertion force can be reduced. Therefore, the tip end of the base portion of the counterpart connection terminal can smoothly enter between the base portion and the divided pieces.

(6) A terminal connection structure includes: a first electric wire connection portion in which an end of a first electric wire is electrically connected to a folded portion of a first connection terminal having a same configuration as that of the connection terminal according to any one of the items (1) to (5), and a second electric wire connection portion in which an end of a second electric wire is electrically connected to a folded portion of a second connection terminal having a same configuration as that of the connection terminal according to any one of the items (1) to (5). A base portion of the second connection terminal is inserted and elastically sandwiched between a base portion and a terminal contact portion of the first connection terminal while the second connection terminal is vertically inverted with respect to the first connection terminal, and the base portion of the first connection terminal is elastically sandwiched between the base portion and a terminal contact portion of the second connection terminal.

According to the terminal connection structure of the item (6), the first electric wire connection portion can be configured to electrically connect the end of the first electric wire to the folded portion of the first connection terminal, and the second electric wire connection portion can be configured to electrically connect the end of the second electric wire to the folded portion of the second connection terminal. The base portions of the second and first connection terminals are elastically sandwiched by the base portions and the terminal contact portions of the first and second connection terminals, respectively, whereby the first connection terminal and the second connection terminal having the same shape are electrically connected. Therefore, the electric wires having ends respectively connected to the first and second electric wire connection portions of the first and second connection terminals are electrically connected to each other.

(7) A connection terminal includes: a plurality of connection terminal portions, each of the plurality of connection terminal portions including: a base portion having a flat shape; a folded portion which is folded back from a rear end of the base portion in a terminal fitting direction and extends toward a front side in the terminal fitting direction, a rise portion that is provided at an intermediate portion of the folded portion in the terminal fitting direction and rises in a direction away from the base portion, and a terminal contact portion that extends from the rise portion toward the front side in the terminal fitting direction and is elastically deformable in the direction away from the base portion at a position facing the base portion; and a coupling portion provided between the base portions of adjacent ones of the plurality of connection terminal portions. A base portion of the connection terminal according to any one of the items (1) to (5) is inserted and elastically sandwiched between the base portion and the terminal contact portion of one of the plurality of connection terminal portions while the connection terminal according to any one of the items (1) to (5) is vertically inverted with respect to the plurality of connection terminal portions.

According to the connection terminal of the item (7), a portion for forming the base portions of the connection terminal portions and the coupling portions has a strip-like busbar shape extending in a longitudinal direction of an elongated flat conductive metal plate. In addition, the folded portion folded back from the rear side of the base portion in the terminal fitting direction, the rise portion provided at the intermediate portion of the folded portion in the terminal fitting direction, and the terminal contact portion that extends from the rise portion to the front side in the terminal fitting direction, are integrally bent and formed. Accordingly, an elongated bent body can be formed in which a plurality of connection terminal portions having a target shape (the same cross-sectional shape along the longitudinal direction) in the longitudinal direction of the elongated flat conductive metal plate are connected via the coupling portions. Therefore, by cutting the elongated bent body at the coupling portions at arbitrary positions in the longitudinal direction, a so-called branch connection terminal having the plurality of connection terminal portions can be easily formed. The connection terminal according to the items (1) to (5) serving as a male-female common terminal is connected to the connection terminal portion of the connection terminal of the configuration.

Therefore, according to the connection terminal of the configuration, the branch connection terminal can be manufactured on a manufacturing line of the connection terminal according to the items (1) to (5), thereby reducing the manufacturing cost. In addition, according to the connection terminal of the configuration, the number of connection terminal portions of the branch connection terminal as well as the number of contacts and the contact area of the terminals can be easily changed.

According to the aspects of the present invention, the manufacturing cost can be reduced by realizing the single type of connection terminals, and the connection terminal and the terminal connection structure can be provided capable of coping with changes in the number of contacts and the contact area of the terminals while reducing the manufacturing cost.

The aspects of the present invention are briefly described as above. Details of the aspects of the present invention are further clarified by reading through modes described below for implementing the present invention (hereinafter, referred to as "embodiments") with reference to attached drawings.

DETAILED DESCRIPTION

Hereinafter, embodiments according to the present invention will be described with reference to the drawings.

Figure 1:
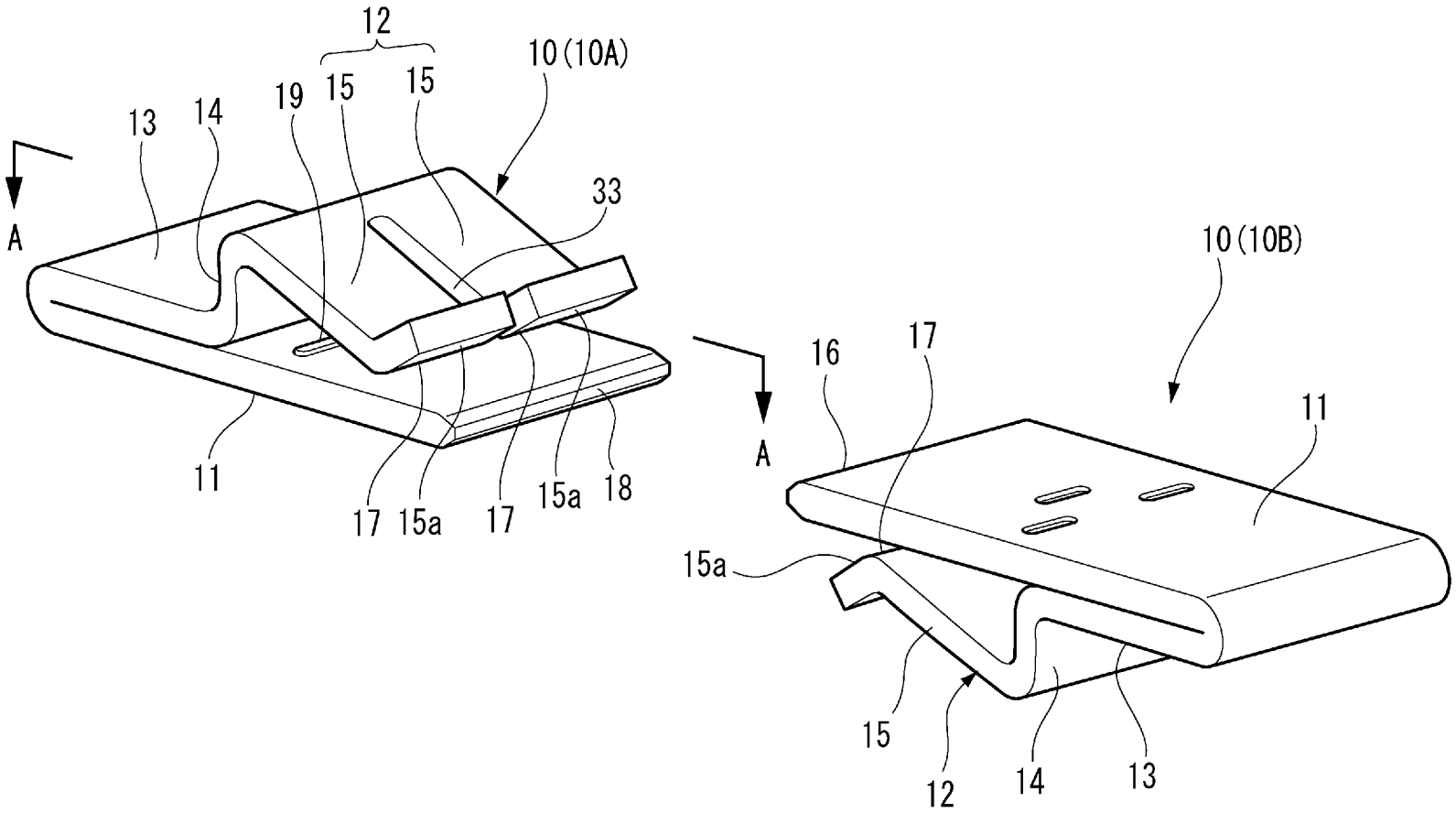
FIG. 1 is a perspective view illustrating a state before a first connection terminal and a second connection terminal according to a first embodiment of the present invention are connected.
Figure 2:
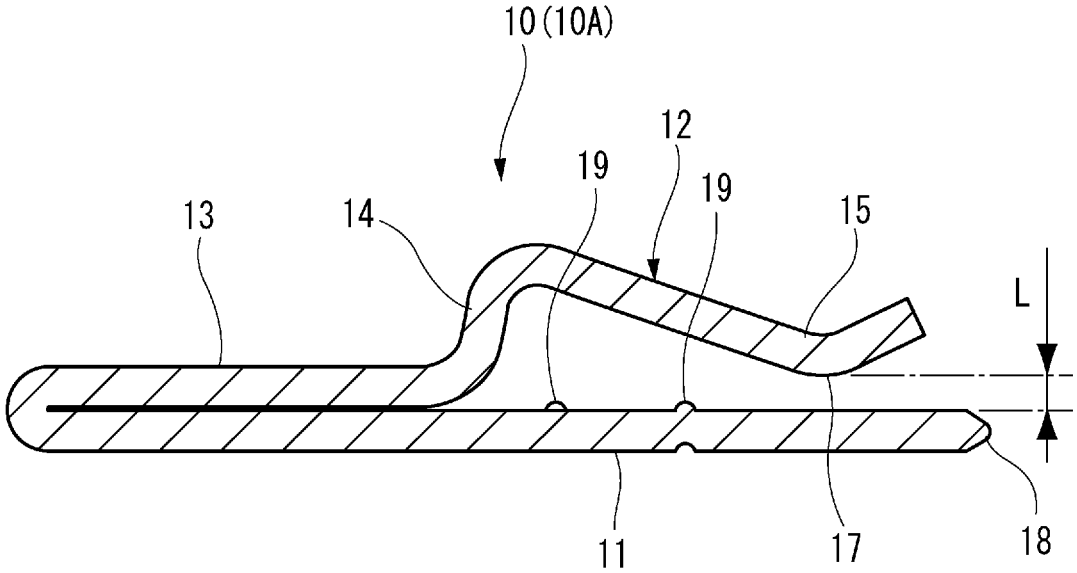
FIG. 2 is a cross-sectional view taken along a line A-A of the first connection terminal illustrated in FIG. 1.

As illustrated in FIGS. 1 and 2, a connection terminal 10 according to a first embodiment of the present invention is a male-female common terminal made of, for example, copper alloy.

The connection terminal 10 according to the first embodiment includes a flat base portion 11 having a predetermined width, a folded portion 13 which is folded back from a rear end (a left side in FIG. 2) of the base portion 11 in a terminal fitting direction and extends toward a front side (a right side in FIG. 2) in the terminal fitting direction, a rise portion 14 that is provided at an intermediate portion of the folded portion 13 in the terminal fitting direction and rises in a direction away from the base portion 11, and a terminal contact portion 12 that extends from the rise portion 14 toward the front side in the terminal fitting direction and can be elastically deformed (displaced) in a direction away from the base portion 11 at a position facing the base portion 11.

The base portion 11 is provided with a plurality of (three in the embodiment) contact protrusions 19 protruding toward the terminal contact portion 12 on a surface facing the terminal contact portion 12 by indenting or the like. The number of the contact protrusions 19 is not limited to three, and the three contact protrusions 19 can be reliably brought into contact with a base portion 11 on a counterpart side. Further, upper and lower edges of a tip end 18 of the base portion 11 inserted between the base portion 11 and a terminal contact portion 12 on the counterpart side are chamfered such that the tip end 18 is tapered.

An end 24 of a conductor 21 of an electric wire 20A (20B) described below is welded onto an upper surface of the folded portion 13 serving as an electric wire connection portion by ultrasonic welding, laser welding or the like. The folded portion 13 and the rise portion 14 folded on one surface side (upper surface side in FIG. 2) of the base portion 11 have a predetermined width same as that of the base portion 11.

The terminal contact portion 12 according to the first embodiment includes a plurality of (two in the first embodiment) divided pieces 15 that are formed by dividing the terminal contact portion 12 in a width direction intersecting the terminal fitting direction by a slit 33 extending from a front end along the terminal fitting direction. An intermediate portion of each divided piece 15 of the terminal contact portion 12 has a contact portion 17 that is bent so as to protrude toward the base portion. Therefore, a tip end of the divided piece 15 extends obliquely away from the base portion, and a surface thereof on the base portion 11 side is an inclined surface 15*a*.

Between the contact portion 17 of the divided piece 15 and the base portion 11, the base portion 11 on the counterpart side can be inserted from the front side in the terminal fitting direction while being vertically inverted.

As illustrated in FIG. 2, a distance L between the contact portion 17 of the divided piece 15 of the terminal contact portion 12 and the base portion 11 is set to be slightly smaller than a thickness of the base portion 11 in a natural state of the divided piece 15. When the base portion 11 on the counterpart side is inserted between the contact portion 17 of the divided piece 15 and the base portion 11, a tip end 18 of the base portion 11 on the counterpart side pushes up the inclined surface 15*a* of the divided piece 15, so that the divided piece 15 is elastically deformed (displaced) upward. The base portion 11 on the counterpart side is elastically sandwiched between the contact portion 17 of the divided piece 15 and the base portion 11 by a reaction force of the divided piece 15.

Connection terminals 10 having the above configuration can form a terminal connection structure according to the first embodiment for electrically connecting the electric wires 20A and 20B to each other by using first and second connection terminals 10A and 10B having the same shape and the same dimension.

Each of the electric wires 20A and 20B is, for example, a coated electric wire in which a periphery of a conductor 21 is coated with an insulator 23. The conductor 21 is formed by twisting together strands of a conductive metal material mainly made of copper. The conductor 21 is extrusion-coated with the insulator 23.

Figure 3:
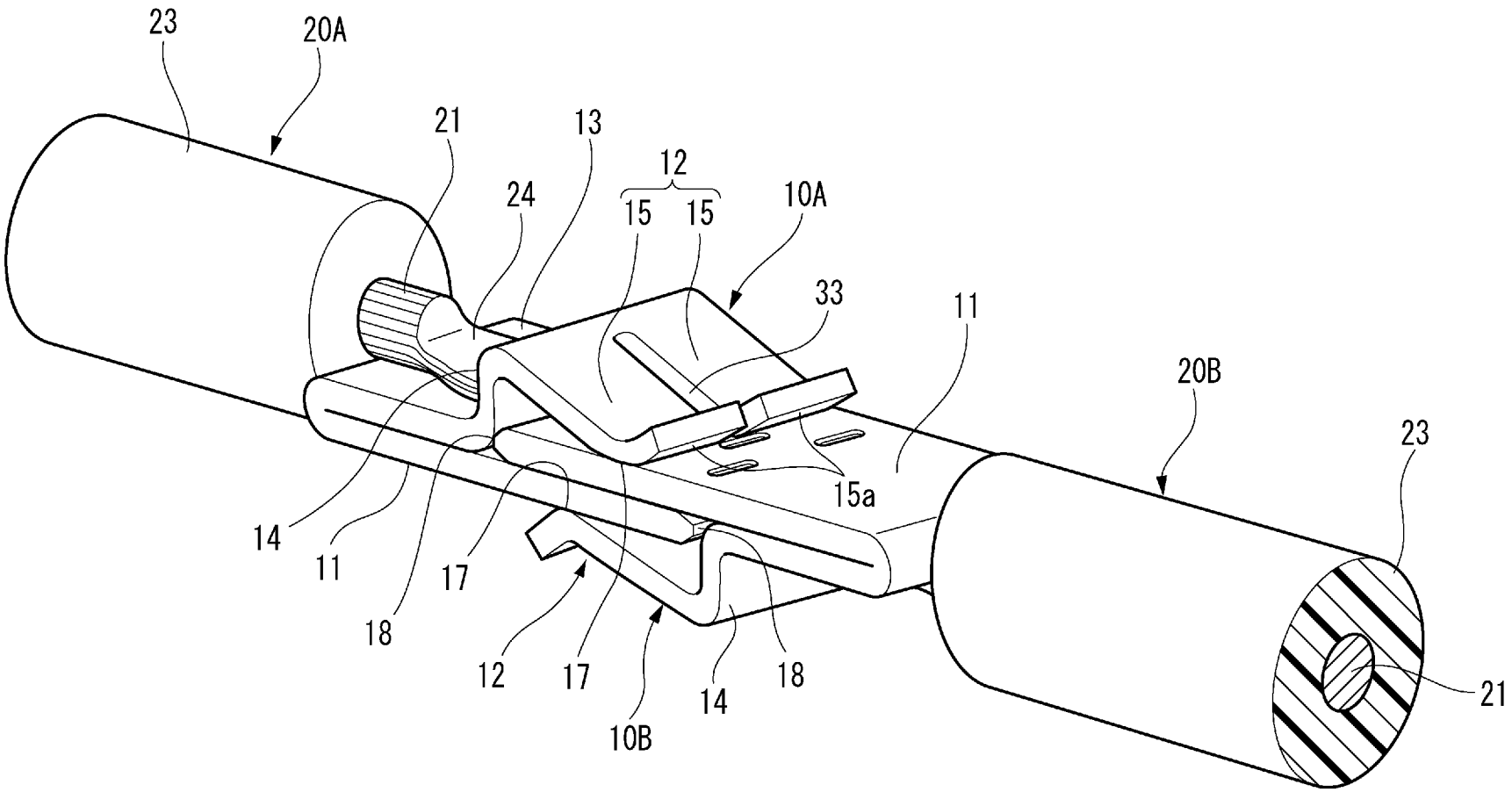
FIG. 3 is a perspective view illustrating a terminal connection structure according to the first embodiment of the present invention, and illustrating a state in which the first connection terminal and the second connection terminal are connected.
Figure 4:
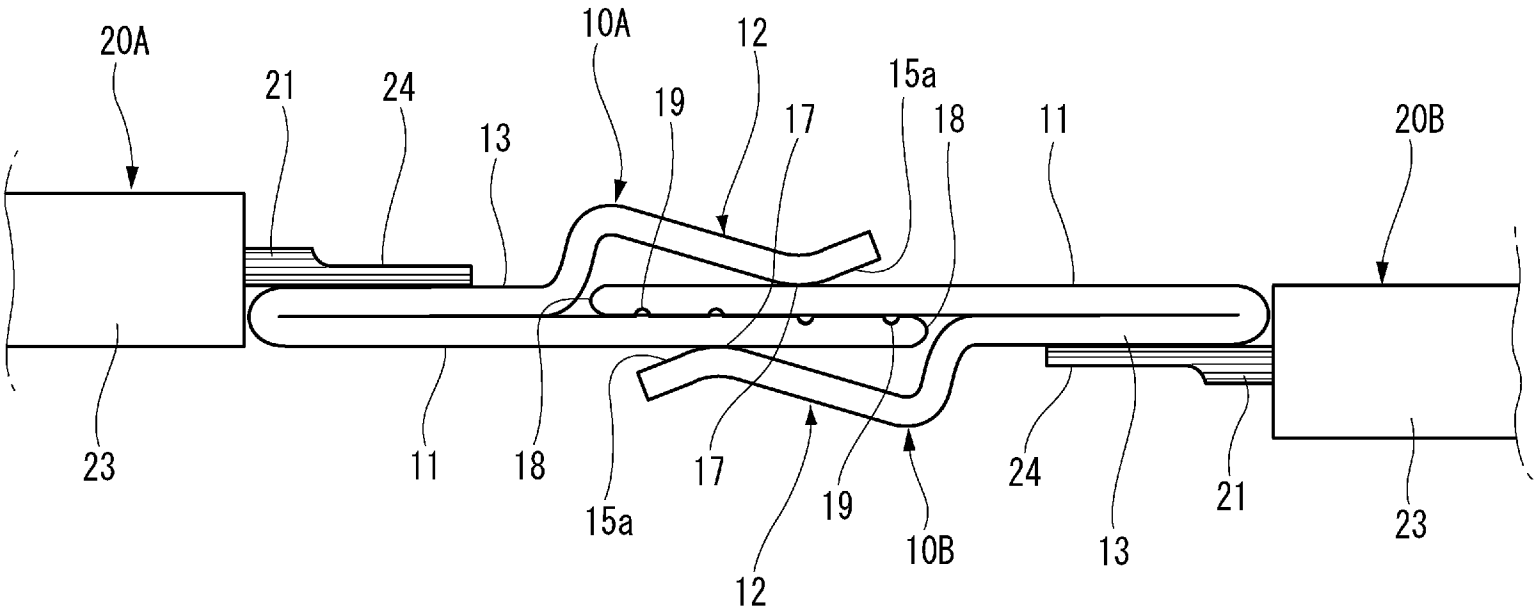
FIG. 4 is a side view of the terminal connection structure illustrated in FIG. 3.

FIGS. 3 and 4 are a perspective view and a side view illustrating the terminal connection structure according to the first embodiment of the present invention, and illustrate a state in which the first connection terminal 10A and the second connection terminal 10B are connected.

In the following description, the connection terminal 10 crimped to an end of one electric wire 20A is referred to as the first connection terminal 10A, and the connection terminal 10 crimped to an end of the other electric wire 20B is referred to as the second connection terminal 10B.

First, the insulator 23 at the end of the electric wire is removed to expose the conductor 21 at the end of one electric wire 20A.

Next, the end 24 of the conductor 21 of one electric wire 20A is welded onto the upper surface of the folded portion 13 serving as the electric wire connection portion of the first connection terminal 10A by ultrasonic welding, laser welding or the like.

Similarly, the insulator 23 at the end of the electric wire is removed to expose the conductor 21 at the end of the other electric wire 20B.

Next, the end 24 of the conductor 21 of the other electric wire 20B is welded onto the upper surface of the folded portion 13 serving as the electric wire connection portion of the second connection terminal 10B by ultrasonic welding, laser welding or the like.

In the terminal connection structure according to the first embodiment, when the first connection terminal 10A and the second connection terminal 10B are connected as illustrated in FIG. 4, as the base portion 11 of the second connection terminal 10B is inserted between the divided piece 15 and the base portion 11 of the first connection terminal 10A while being vertically inverted, the base portion 11 of the first connection terminal 10A also enters between the base portion 11 and the divided piece 15 of the second connection terminal 10B. Therefore, the base portion 11 of the second connection terminal 10B is elastically sandwiched between the contact portion 17 of the divided piece 15 and the base portion 11 of the first connection terminal 10A, and the base portion 11 of the first connection terminal 10A is elastically sandwiched between the contact portion 17 of the divided piece 15 and the base portion 11 of the second connection terminal 10B.

According to the connection terminal 10 (10A, 10B) according to the first embodiment described above, a pair of connection terminals 10A and 10B can be electrically connected to each other by elastically sandwiching the base portion 11 on the counterpart side by the base portion 11 and the terminal contact portion 12 (divided piece 15). Therefore, it is not necessary to distinguish male and female of the connection terminals 10A and 10B, so that the workability is high and the component management is facilitated. Therefore, the manufacturing cost of the connection terminals 10 can be reduced by realizing a single type of the connection terminals 10 (10A, 10B) as male-female common terminals.

Figure 5A:
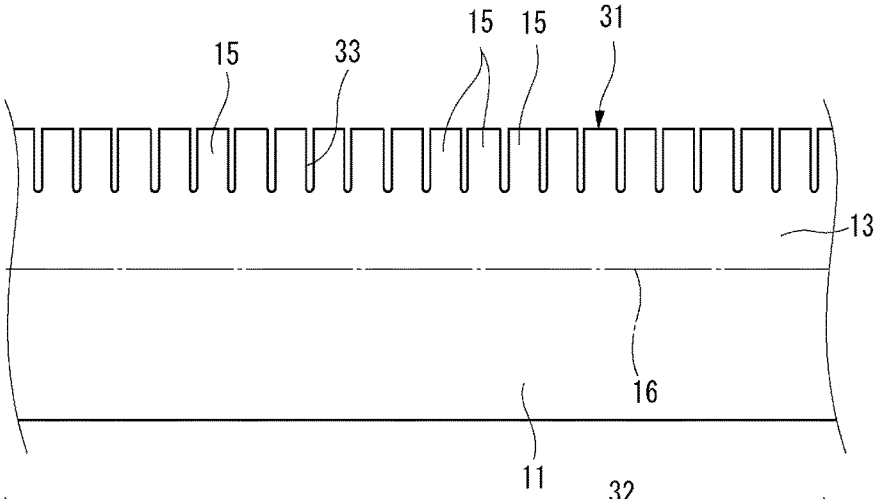
FIGS. 5A to 5C are explanatory views illustrating a step of press-molding the connection terminal according to the first embodiment of the present invention.
Figure 5B:
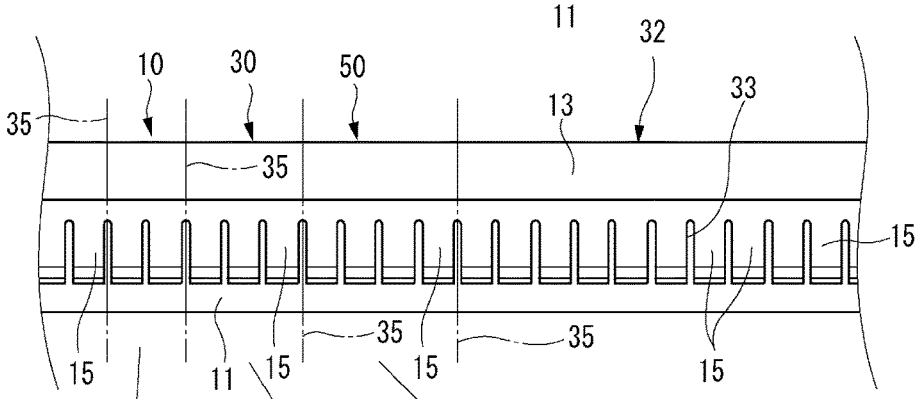
Figure 5C:
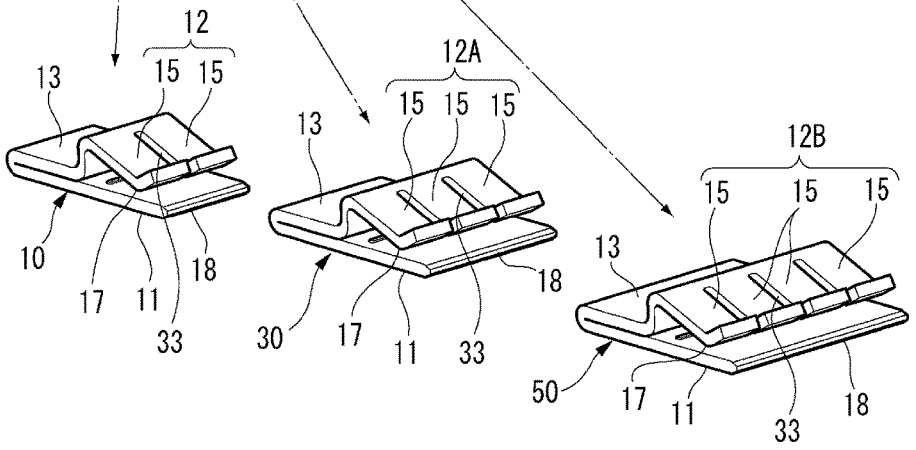

FIGS. 5A to 5C are explanatory views illustrating a step of press-molding the connection terminal 10 according to the first embodiment of the present invention.

According to the connection terminal 10 according to the first embodiment as illustrated in FIGS. 5A and 5B, a portion for forming base portions 11 has a strip-like bus bar shape extending in a longitudinal direction of an elongated flat conductive metal plate 31. In addition, the folded portion 13 which is folded back from the rear end of the base portion 11 in the terminal fitting direction at a fold line 16 extending in the longitudinal direction, the rise portion 14 provided at the intermediate portion of the folded portion 13 in the terminal fitting direction, the terminal contact portion 12 that extends from the rise portion 14 toward the front side in the terminal fitting direction, can be formed to have an target shape (the same cross-sectional shape along the longitudinal direction) in the longitudinal direction of the elongated flat conductive metal plate 31.

The step of press-molding the connection terminal 10 and connection terminals 30 and 50 according to the first embodiment of the present invention will be described with reference to FIGS. 5A to 5C.

First, as illustrated in FIG. 5A, a plurality of slits 33 extending toward the other side edge are cut out at predetermined intervals on one side edge (upper edge in FIG. 5A) along the longitudinal direction of the conductive metal plate 31. The formation intervals of the slits 33 are set in accordance with a width of each divided piece 15 of the terminal contact portion 12.

Next, as illustrated in FIG. 5B, a side edge side of the conductive metal plate 31 along the longitudinal direction is folded back at the fold line 16 extending in the longitudinal direction, and an elongated bent body 32 is formed by integrally bending and forming portions constituting the folded portion 13, the rise portion 14 and the terminal contact portion 12.

Therefore, by cutting the elongated bent body 32 at arbitrary cutting positions 35 in the longitudinal direction, the connection terminals 10, 30 and 50 can be easily formed to include the terminal contact portions 12, 12A and 12B having different lengths in the width direction intersecting the terminal fitting direction. Specifically, as illustrated in FIGS. 5B and 5C, by cutting at the cutting positions 35 extending along the slits 33 such that the terminal contact portion 12 is formed by two divided pieces 15, the connection terminal 10 according to the first embodiment is formed. In addition, by cutting at the cutting positions 35 extending along the slits 33 such that the terminal contact portion 12A is formed by three divided pieces 15, the connection terminal 30 is formed in which the number of contacts and the contact area are larger than those of the connection terminal 10. Further, by cutting at the cutting positions 35 extending along the slits 33 such that the terminal contact portion 12B is formed by four divided pieces 15, the connection terminal 50 is formed in which the number of contacts and the contact area are larger than those of the connection terminal 30.

As described above, according to the connection terminal 10 of the first embodiment, the number of contacts and the contact area of the terminals can be easily changed.

According to the connection terminal 10 (10A, 10B) according to the first embodiment, the intermediate portion of the terminal contact portion 12 has the contact portion 17 that is bent so as to protrude toward the base portion 11. Therefore, when the base portion 11 on the counterpart side is inserted from the front side in the terminal fitting direction, the tip end 18 of the base portion 11 on the counterpart side can push up the inclined surface 15*a* at a tip end of the terminal contact portion 12 to smoothly enter between the base portion 11 and the terminal contact portion 12.

Since the contact portion 17 of the terminal contact portion 12 comes into contact with the base portion 11 on the counterpart side, the contact portion 17 of the terminal contact portion 12 can be reliably brought into contact with the base portion 11 on the counterpart side even when prying occurs in a vertical direction (a thickness direction) with respect to the connection terminals 10. Therefore, the contact area between the connection terminals can be prevented from reducing, thereby ensuring the connection reliability.

According to the connection terminal 10 (10A, 10B) according to the first embodiment, since the contact protrusions 19 of the base portion 11 reliably come into contact with the base portion 11 on the counterpart side, the contact area are increased due to an increase in the number of contacts between the connection terminals, thereby improving the connection reliability.

According to the connection terminal 10 (10A, 10B) according to the first embodiment, since the terminal contact portion 12 includes two divided pieces 15, each of the divided pieces 15 can independently come into contact with the base portion 11 on the counterpart side. Therefore, the divided pieces 15 of the terminal contact portion 12 can be reliably brought into contact with the base portion 11 on the counterpart side even when prying occurs in a rotation direction (a direction of rotating about the terminal fitting direction) with respect to the connection terminals 10 (10A, 10B). Therefore, the contact area between the connection terminals can be prevented from reducing, thereby ensuring the connection reliability.

According to the terminal connection structure according to the first embodiment, the electric wire connection portion can be configured to electrically connect the end of one electric wire 20A to the folded portion 13 of the first connection terminal 10A, and the electric wire connection portion can be configured to electrically connect the end of the other electric wire 20B to the folded portion 13 of the second connection terminal 10B. The base portions 11 of the second and first connection terminals 10B and 10A are elastically sandwiched by the base portions 11 and the terminal contact portions 12 of the first and second connection terminals 10A and 10B respectively, whereby the first connection terminal 10A and the second connection terminal 10B having the same shape are electrically connected. Therefore, the electric wires 20A and 20B whose electric wire ends are respectively connected to the electric wire connection portions of the first and second connection terminals 10A and 10B are electrically connected to each other.

Therefore, according to the connection terminal 10 (10A, 10B) and the terminal connection structure according to the first embodiment, the manufacturing cost can be reduced by realizing the single type of connection terminals 10, and the number of contacts and the contact area can be changed while reducing the manufacturing cost.

The present invention is not limited to the embodiment described above, and modifications, improvements and the like can be made as appropriate. In addition, materials, shapes, dimensions, numbers, disposition locations or the like of constituent elements in the above-described embodiment are optional and not limited as long as the object of the embodiments of the present invention can be achieved.

Figure 6A:
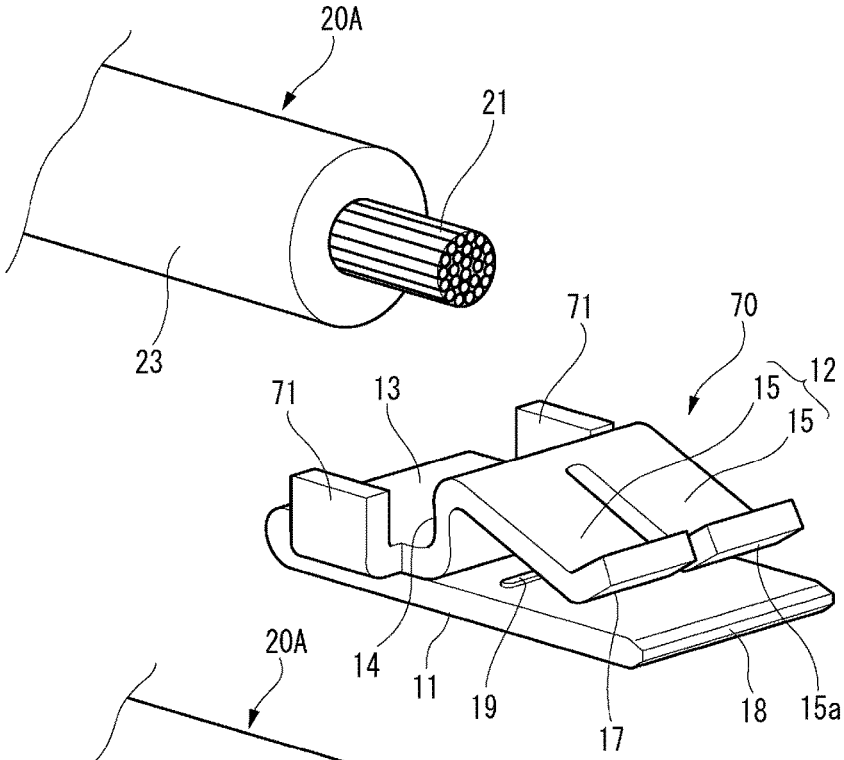
FIG. 6A is a perspective view illustrating a terminal connection structure according to a modification of the embodiment.
Figure 6B:
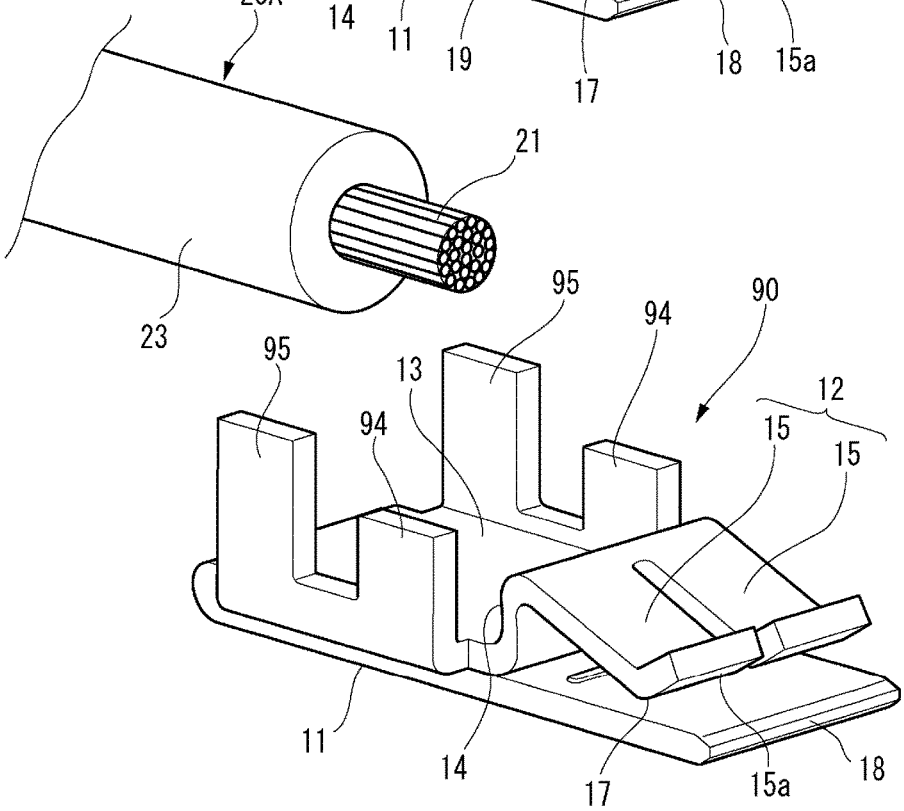
FIG. 6B is a perspective view illustrating a terminal connection structure according to another modification of the embodiment.

FIG. 6A is a perspective view illustrating a terminal connection structure according to a modification of the embodiment, and FIG. 6B is a perspective view illustrating a terminal connection structure according to another modification of the embodiment. Components same as those of the terminal connection structure according to the first embodiment are denoted by the same reference numerals, and a detailed description thereof is omitted.

In a connection terminal 70 according to the modification of the embodiment as illustrated in FIG. 6A, a pair of side walls 71 are bent and formed on both side edges of the folded portion 13 serving as an electric wire connection portion.

Therefore, when an end of the conductor 21 of the electric wire 20A is ultrasonically welded onto an upper surface of the folded portion 13, the pair of side walls 71 can restrain the end of the conductor 21. Therefore, when the conductor 21 is ultrasonically welded, strands twisted together can be prevented from loosening. A connection area between the connection terminal 70 and the conductor 21 is a flat surface restricted by the folded portion 13 and the pair of side walls 71, so that the contact area can be increased. Therefore, the connectivity between the connection terminal 70 and the conductor 21 can be improved.

In a connection terminal 90 according to another modification of the embodiment as illustrated in FIG. 6B, a pair of conductor caulking pieces 94 and a pair of coat caulking pieces 95 are bent and formed, and spaced apart in the terminal fitting direction on both side edges of the folded portion 13 serving as an electric wire connection portion.

Therefore, at the end of the electric wire 20A, the conductor 21 is crimped by the conductor caulking pieces 94, and the adjacent insulator 23 is crimped by the coat caulking pieces 95.

Accordingly, a configuration of the folded portion 13 serving as the electric wire connection portion according to the embodiment may be of various types depending on the form, thickness and the like of an electric wire to be connected.

Figure 7A:
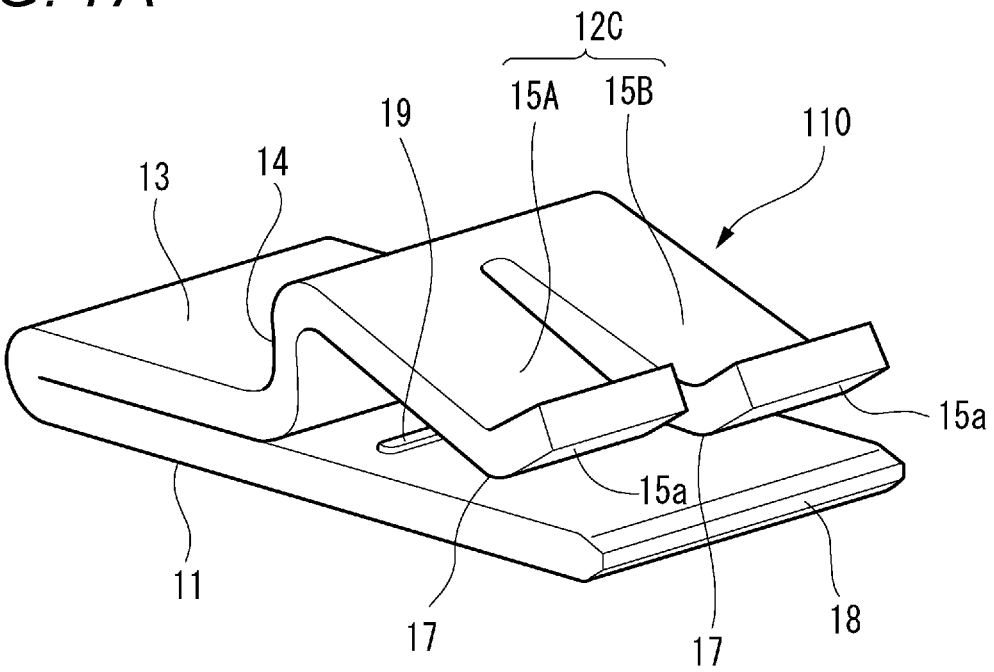
FIG. 7A is a perspective view illustrating a connection terminal according to a second embodiment of the present invention.
Figure 7B:
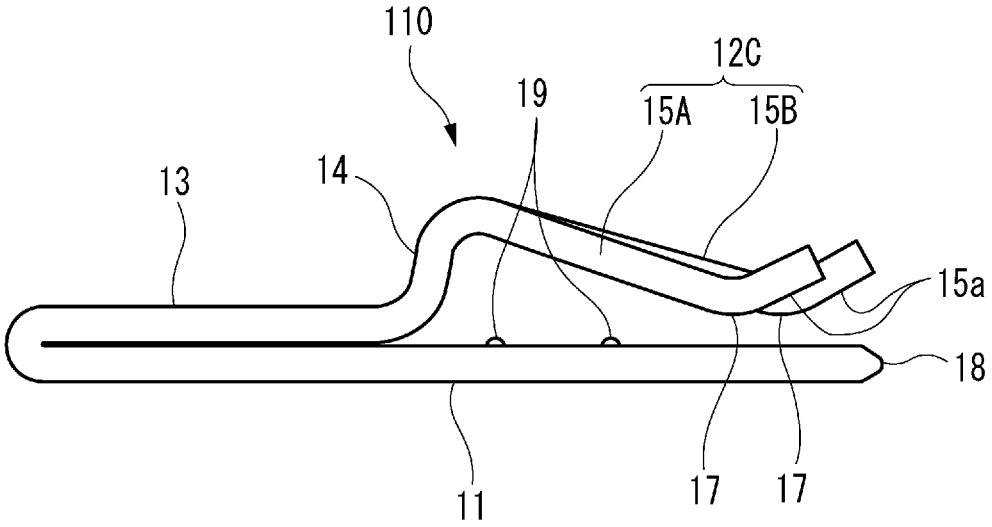
FIG. 7B is a side view of the connection terminal illustrated in FIG. 7A.

FIGS. 7A and 7B are a perspective view and a side view illustrating a connection terminal 110 according to a second embodiment of the present invention. Components same as those of the connection terminal 10 according to the first embodiment are denoted by the same reference numerals, and a detailed description thereof is omitted.

In the connection terminal 110 according to the second embodiment as illustrated in FIGS. 7A and 7B, two divided pieces 15A and 15B constituting a terminal contact portion 12C are configured to elastically sandwich the base portion 11 of another connection terminal 110 with the base portion 11 at different positions along the terminal fitting direction.

Therefore, according to the connection terminal 110 according to the second embodiment, when the base portion 11 on a counterpart side is inserted from a front side in the terminal fitting direction, the tip end 18 of the base portion 11 on the counterpart side reaches sandwiching positions of the divided pieces 15A and 15B at different timings, respectively, and a peak value of the insertion force can be reduced. Therefore, the tip end 18 of the base portion 11 on the counterpart side can smoothly enter between the base portion 11 and the divided pieces 15A and 15B.

Figure 8:
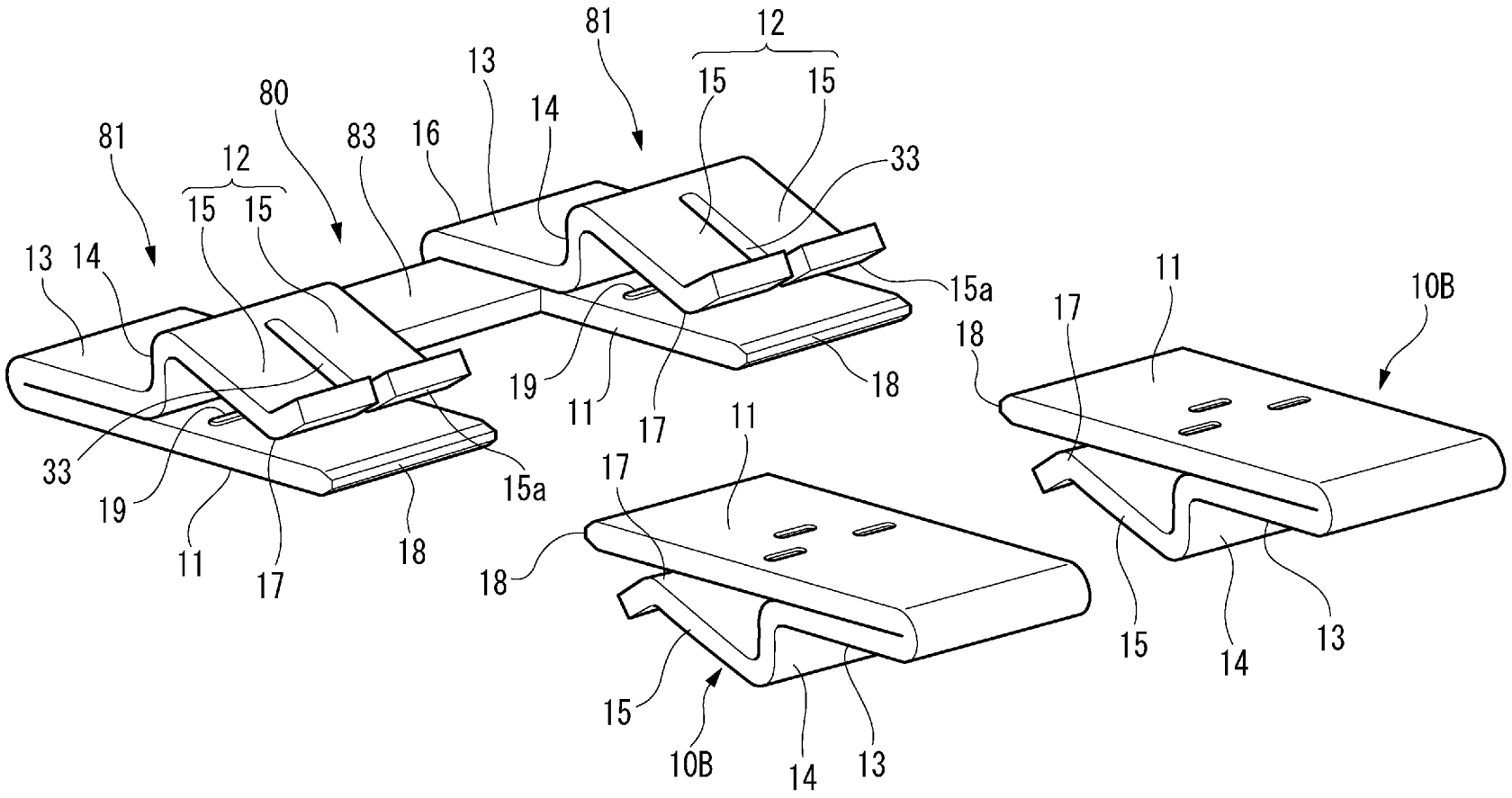
FIG. 8 is a perspective view illustrating a connection terminal according to a third embodiment of the present invention.
Figure 9:
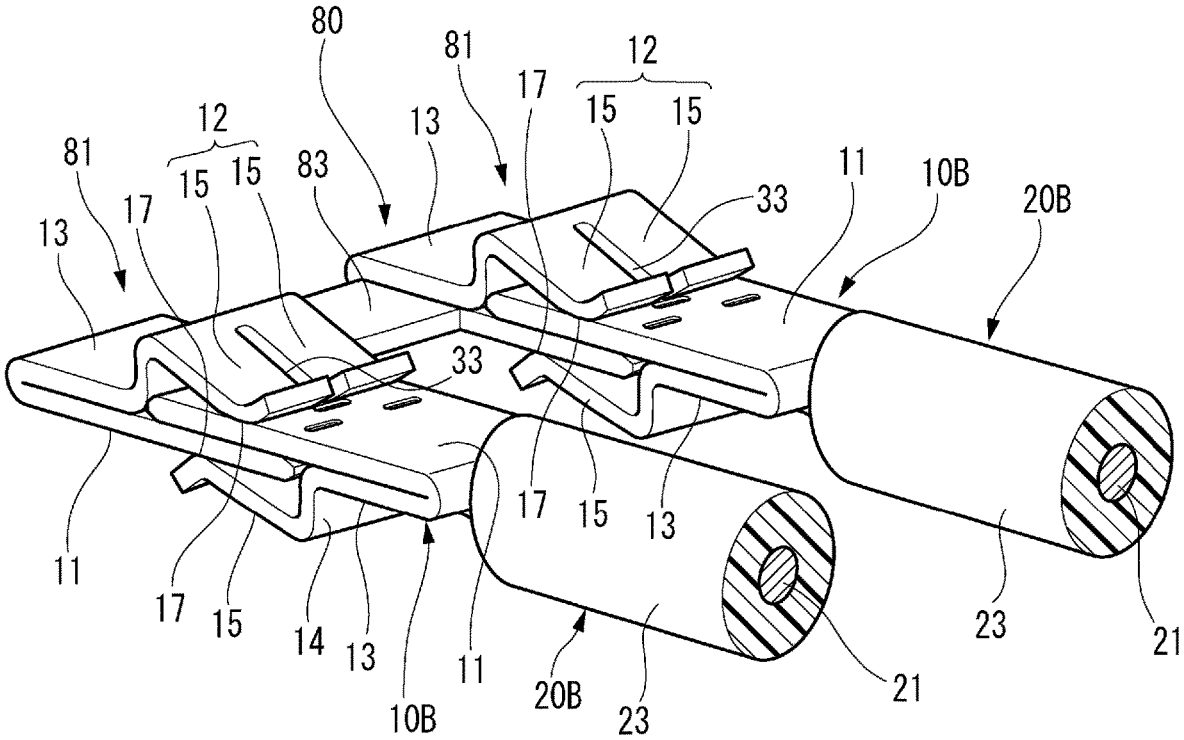
FIG. 9 is a perspective view illustrating a terminal connection structure using the connection terminal illustrated in FIG. 8.

FIG. 8 is a perspective view illustrating a connection terminal 80 according to a third embodiment of the present invention. FIG. 9 is a perspective view illustrating a terminal connection structure using the connection terminal 80 illustrated in FIG. 8. Components same as those of the connection terminal 10 according to the first embodiment are denoted by the same reference numerals, and a detailed description thereof is omitted.

As illustrated in FIG. 8, the connection terminal 80 is a branch connection terminal that includes a pair of connection terminal portions 81, and a coupling portion 83 provided between adjacent base portions 11 of the pair of connection terminal portions 81. The connection terminal portion 81 includes the flat base portion 11 having a predetermined width, the folded portion 13 in which a rear side (a left side in FIG. 8) of the base portion in the terminal fitting direction is folded back and extends toward a front side (a right side in FIG. 8) of the terminal fitting direction, the rise portion 14 that rises away from the base portion 11 at an intermediate portion of the folded portion 13 in the terminal fitting direction, the terminal contact portion 12 that extends from the rise portion 14 to the front side in the terminal fitting direction and can be elastically deformed (displaced) in a direction away from the base portion 11 at a position facing the base portion 11.

According to such a connection terminal 80, a portion for forming base portions 11 of the connection terminal portions 81 and the coupling portion 83 has a strip-like busbar shape extending in a longitudinal direction of an elongated flat conductive metal plate. In addition, the folded portion 13 in which the rear side of the base portion 11 in the terminal fitting direction is folded back, the rise portion 14 provided at the intermediate portion of the folded portion 13 in the terminal fitting direction, and the terminal contact portion 12 that extends from the rise portion 14 to the front side in the terminal fitting direction, are integrally bent and formed. Accordingly, an elongated bent body can be formed in which a plurality of connection terminal portions 81 having a target shape (the same cross-sectional shape along the longitudinal direction) in the longitudinal direction of the elongated flat conductive metal plate are connected via coupling portions 83 (see FIGS. 5A to 5C). Therefore, by cutting the elongated bent body at the coupling portions 83 at arbitrary positions in the longitudinal direction, the connection terminal 80 serving as the branch connection terminal having a plurality of connection terminal portions 81 can be easily formed.

As illustrated in FIG. 8, the connection terminal 10B of the above configuration serving as a male-female common terminal is connected to the connection terminal portion 81 of the connection terminal 80 of the configuration.

Therefore, as illustrated in FIG. 9, the connection terminal 80 serving as the branch connection terminal can be configured as a joint terminal to which connection terminals 10B connected to ends of a pair of electric wires 20B are respectively connected.

Figure 10:
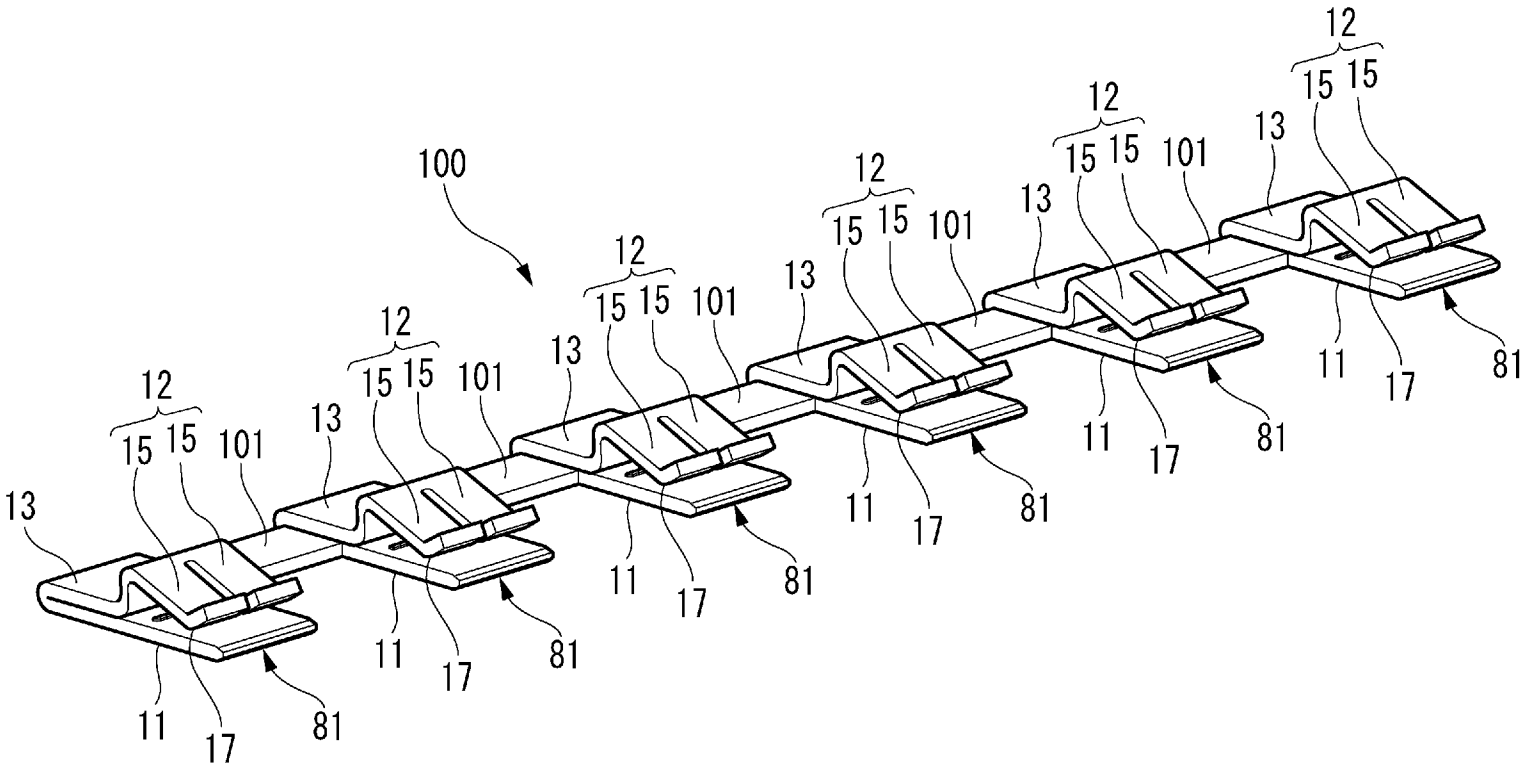
FIG. 10 is a perspective view illustrating a modification of the connection terminal illustrated in FIG. 8.

A connection terminal 100 serving as a branch connection terminal illustrated in FIG. 10 can also be configured as a joint terminal including a large number of (six in the embodiment) connection terminal portions 81 and coupling portions 101 respectively provided between adjacent base portions 11 of the connection terminal portions 81.

Therefore, according to the connection terminals 80 and 100 of the configuration, the branch connection terminals 80 and 100 can be manufactured on a manufacturing line of the connection terminal 10 having the above configuration, thereby reducing the manufacturing cost. According to the connection terminals 80 and 100 of the configuration, the number of the connection terminal portions 81 of the branch connection terminal, the number of contacts and the contact area of the terminals, and the like can be easily changed.

Here, features of the embodiments of the connection terminal and the terminal connection structure according to the aspects of the present invention are briefly summarized and listed in the following items [1] to [7].

[1] A connection terminal (10; 30; 50; 70; 90; 110) comprising:

a base portion (11) having a flat shape;

a folded portion (13) which is folded back from a rear end of the base portion in a terminal fitting direction and extends toward a front side in the terminal fitting direction;

a rise portion (14) that is provided at an intermediate portion of the folded portion in the terminal fitting direction and rises in a direction away from the base portion (11); and a terminal contact portion (12; 12A; 12B; 12C) that extends from the rise portion (14) toward the front side in the terminal fitting direction and is elastically deformable in a direction away from the base portion (11) at a position facing the base portion (11), wherein the connection terminal (10; 30; 50; 70; 90; 110) is configured to receive a base portion (11) of a counterpart connection terminal having a same configuration as that of the connection terminal (10; 30; 50; 70; 90; 110) such that the base portion of the counterpart connection terminal is inserted and elastically sandwiched between the base portion (11) and the terminal contact portion (12; 12A; 12B; 12C) of the connection terminal (10; 30; 50; 70; 90; 110) while the counterpart connection terminal is vertically inverted with respect to the connection terminal (10; 30; 50; 70; 90; 110).

[2] The connection terminal (10; 30; 50; 70; 90; 110) according to the item [1], wherein the terminal contact portion (12; 12A; 12B; 12C) includes a contact portion (17) which is provided at an intermediate portion of the terminal contact portion (12; 12A; 12B; 12C) in the terminal fitting direction and which is bent so as to protrude toward the base portion.

[3] The connection terminal (10; 30; 50; 70; 90; 110) according to the item [1] or [2], wherein the base portion (11) includes a contact protrusion (19) that protrudes toward the terminal contact portion (12; 12A; 12B; 12C) from a surface of the base portion (11) facing the terminal contact portion (12; 12A; 12B; 12C).

[4] The connection terminal (10; 30; 50; 70; 90; 110) according to any one of the items [1] to [3], wherein the terminal contact portion (12; 12A; 12B; 12C) includes a plurality of divided pieces (15; 15A, 15B) formed by dividing the terminal contact portion (12; 12A; 12B; 12C) in a width direction intersecting the terminal fitting direction by a slit (33) formed between adjacent ones of the plurality of divided pieces (15; 15A, 15B) and extending from a front end of the terminal contact portion (12; 12A; 12B; 12C) along the terminal fitting direction.

[5] The connection terminal (110) according to the item [1], wherein the terminal contact portion (12C) includes a plurality of divided pieces (15A, 15B) formed by dividing the terminal contact portion (12C) in a width direction intersecting the terminal fitting direction by a slit (33) formed between adjacent ones of the plurality of divided pieces (15A, 15B) and extending from a front end of the terminal contact portion (12C) along the terminal fitting direction, wherein the terminal contact portion (12C) includes a plurality of contact portions (17) which are provided at intermediate portions of the plurality of divided pieces (15A, 15B) in the terminal fitting direction, respectively, and which are bent so as to protrude toward the base portion (11), and wherein the plurality of contact portions (17) are provided at different positions along the terminal fitting direction, respectively.

[6] A terminal connection structure comprising:

a first electric wire connection portion in which an end of a first electric wire (20A) is electrically connected to a folded portion (13) of a first connection terminal (10A) having a same configuration as that of the connection terminal according to any one of the items [1] to [5]; and a second electric wire connection portion in which an end of a second electric wire (20B) is electrically connected to a folded portion (13) of a second connection terminal (10B) having a same configuration as that of the connection terminal according to any one of the items [1] to [5], wherein a base portion (11) of the second connection terminal is inserted and elastically sandwiched between a base portion (11) and a terminal contact portion (12) of the first connection terminal while the second connection terminal (10B) is vertically inverted with respect to the first connection terminal (10A), and the base portion (11) of the first connection terminal is elastically sandwiched between the base portion (11) and a terminal contact portion (12) of the second connection terminal.

[7] A connection terminal (80) comprising:

a plurality of connection terminal portions (81), each of the plurality of connection terminal portions including:

a base portion (11) having a flat shape;

a folded portion (13) which is folded back from a rear end of the base portion in a terminal fitting direction and extends toward a front side in the terminal fitting direction;

a rise portion (14) that is provided at an intermediate portion of the folded portion in the terminal fitting direction and rises in a direction away from the base portion; and a terminal contact portion (12) that extends from the rise portion toward the front side in the terminal fitting direction and is elastically deformable in a direction away from the base portion at a position facing the base portion; and a coupling portion (83) provided between the base portions of adjacent ones of the plurality of connection terminal portions, wherein a base portion (11) of the connection terminal (10; 30; 50; 70; 90; 110) according to any one of the items [1] to [5] is inserted and elastically sandwiched between the base portion and the terminal contact portion of one of the plurality of connection terminal portions while the connection terminal (10; 30; 50; 70; 90; 110) according to any one of the items [1] to [5] is vertically inverted with respect to the plurality of connection terminal portions (81).

The invention claimed is:

1. A connection terminal comprising:

a base portion having a flat shape;

a folded portion which is folded back from a rear end of the base portion in a terminal fitting direction and extends toward a front side in the terminal fitting direction;

a rise portion that is provided at an intermediate portion of the folded portion in the terminal fitting direction and rises in a direction away from the base portion; and a terminal contact portion that extends from the rise portion toward the front side in the terminal fitting direction and is elastically deformable in the direction away from the base portion at a position facing the base portion, wherein the folded portion has a same width as the base portion, and wherein the connection terminal is configured to receive a base portion of a counterpart connection terminal having a same configuration as that of the connection terminal such that the base portion of the counterpart connection terminal is inserted and elastically sandwiched between the base portion and the terminal contact portion of the connection terminal while the counterpart connection terminal is vertically inverted with respect to the connection terminal.

2. The connection terminal according to claim 1, wherein the terminal contact portion comprises a contact portion which is provided at an intermediate portion of the terminal contact portion in the terminal fitting direction and which is bent so as to protrude toward the base portion.

3. The connection terminal according to claim 1, wherein the base portion comprises a contact protrusion that protrudes toward the terminal contact portion from a surface of the base portion facing the terminal contact portion.

4. The connection terminal according to claim 1, wherein the terminal contact portion comprises a plurality of divided pieces formed by dividing the terminal contact portion in a width direction intersecting the terminal fitting direction by a slit formed between adjacent ones of the plurality of divided pieces and extending from a front end of the terminal contact portion along the terminal fitting direction.

5. The connection terminal according to claim 1, wherein the terminal contact portion comprises a plurality of divided pieces formed by dividing the terminal contact portion in a width direction intersecting the terminal fitting direction by a slit formed between adjacent ones of the plurality of divided pieces and extending from a front end of the terminal contact portion along the terminal fitting direction, wherein the terminal contact portion comprises a plurality of contact portions which are provided at intermediate portions of the plurality of divided pieces in the terminal fitting direction, respectively, and which are bent so as to protrude toward the base portion, and wherein the plurality of contact portions are provided at different positions along the terminal fitting direction, respectively.

6. A terminal connection structure comprising:

a first electric wire connection portion in which an end of a first electric wire is electrically connected to a folded portion of a first connection terminal having a same configuration as that of the connection terminal according to claim 1; and a second electric wire connection portion in which an end of a second electric wire is electrically connected to a folded portion of a second connection terminal having a same configuration as that of the connection terminal according to claim 1, wherein a base portion of the second connection terminal is inserted and elastically sandwiched between a base portion and a terminal contact portion of the first connection terminal while the second connection terminal is vertically inverted with respect to the first connection terminal, and the base portion of the first connection terminal is elastically sandwiched between the base portion and a terminal contact portion of the second connection terminal.

7. A connection terminal comprising:

a plurality of connection terminal portions, each of the plurality of connection terminal portions comprising:

a base portion having a flat shape;

a folded portion which is folded back from a rear end of the base portion in a terminal fitting direction and extends toward a front side in the terminal fitting direction;

a rise portion that is provided at an intermediate portion of the folded portion in the terminal fitting direction and rises in a direction away from the base portion; and a terminal contact portion that extends from the rise portion toward the front side in the terminal fitting direction and is elastically deformable in the direction away from the base portion at a position facing the base portion; and a coupling portion provided between the base portions of adjacent ones of the plurality of connection terminal portions, wherein a base portion of the connection terminal according to claim 1 is inserted and elastically sandwiched between the base portion and the terminal contact portion of one of the plurality of connection terminal portions while the connection terminal according to claim 1 is vertically inverted with respect to the plurality of connection terminal portions.

8. The connection terminal according to claim 4, wherein a number of the plurality of divided pieces is equal to or greater than three.

9. The connection terminal according to claim 7, wherein the terminal contact portion comprises a plurality of divided pieces formed by dividing the terminal contact portion in a width direction intersecting the terminal fitting direction by a slit formed between adjacent ones of the plurality of divided pieces and extending from a front end of the terminal contact portion along the terminal fitting direction.

* * * * *